US005107935A

United States Patent [19]

McBride

[11] Patent Number: 5,107,935

[45] Date of Patent: Apr. 28, 1992

[54] STAKE SETTING ACCESSORY FOR JACK HAMMER

[75] Inventor: L. Robert McBride, Atascadero, Calif.

[73] Assignee: Marvin Richard Teaby, Oceano, Calif. ; a part interest

[21] Appl. No.: 744,812

[22] Filed: Aug. 12, 1991

Related U.S. Application Data

[63] Continuation of Ser. No. 534,961, Jun. 8, 1990, abandoned.

[51] Int. Cl.[5] ..... B25D 1/04

[52] U.S. Cl. ..... 173/130; 173/132; 269/25; 269/268; 269/270

[58] Field of Search ..... 173/1, 32, 53-56, 173/128-131; 279/19, 19.1; 269/8, 25, 89, 100, 238, 265, 268, 270, 902

[56] References Cited

U.S. PATENT DOCUMENTS

| | | | |
|---|---|---|---|
| 1,827,957 | 10/1931 | Shaw | 173/130 |
| 1,847,135 | 3/1932 | Oldham | 173/130 |
| 1,853,128 | 4/1932 | Hysing et al. | 173/132 |
| 2,127,008 | 8/1938 | Petersen | 269/268 |
| 2,887,918 | 5/1959 | Benson | 269/270 |
| 3,202,023 | 8/1965 | Parker | 269/270 |
| 3,406,764 | 10/1968 | Cerra | 173/55 |
| 3,454,113 | 7/1969 | Holtz | 173/130 |
| 4,076,227 | 2/1978 | Rameson | 269/25 |
| 4,142,714 | 3/1979 | Diepeveen | 269/8 |

*Primary Examiner*—Mark Rosenbaum
*Assistant Examiner*—Scott A. Smith
*Attorney, Agent, or Firm*—Lyon & Lyon

[57] ABSTRACT

An accessory for a jack hammer that includes clamping means for gripping the upper end of the stake so that the stake can be controllably driven into the ground by the user. The accessory includes a stake receiver that has a channel into which the end portion of the stake is inserted and further includes a jaw and clamping means for forceably retaining the jaw against the inserted stake. The channel includes guide ways that permit it to be used interchangeably with the more common sizes and shapes of stakes.

7 Claims, 2 Drawing Sheets

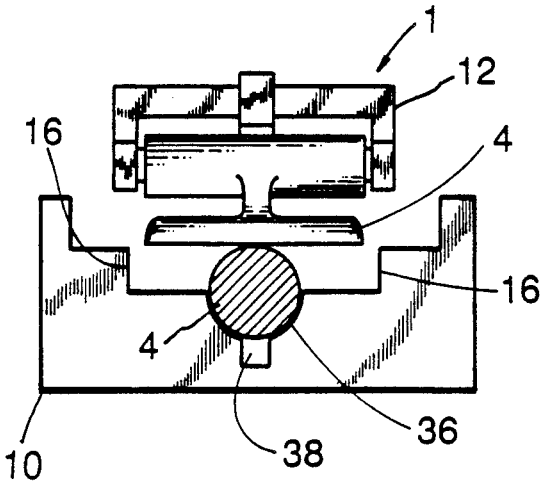
Fig. 3
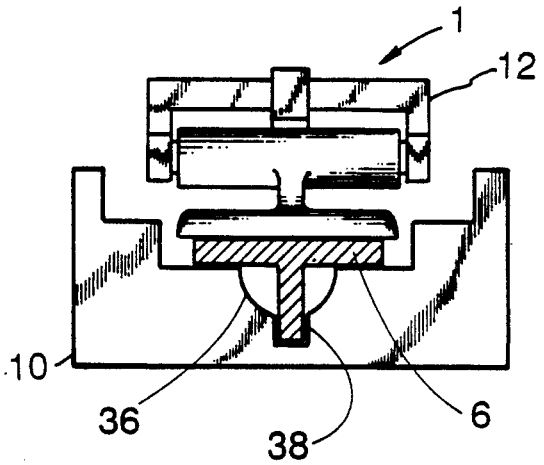
Fig. 4
Fig. 5
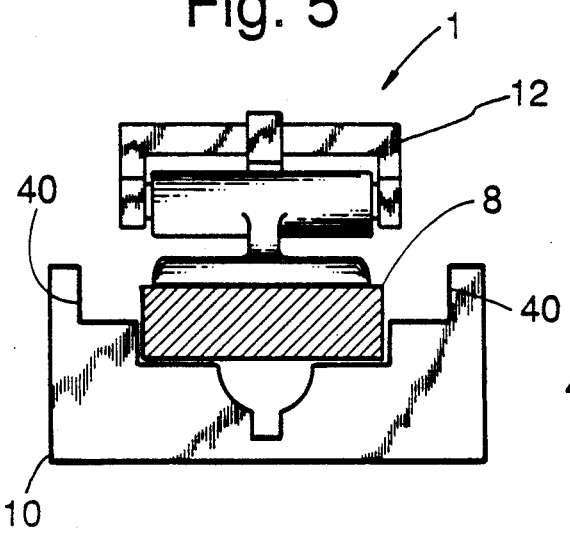
Fig. 6
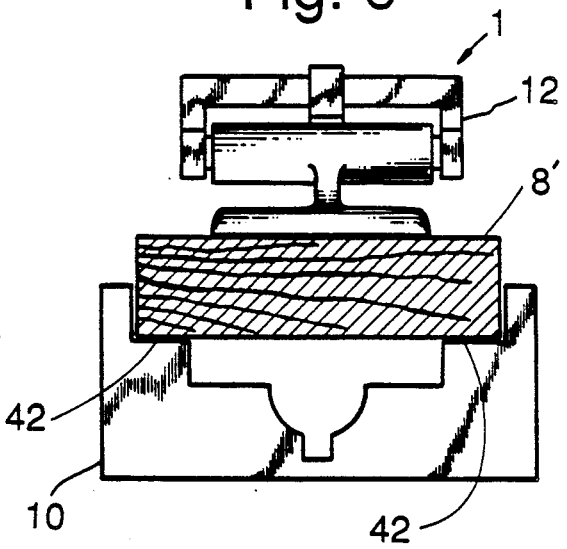

STAKE SETTING ACCESSORY FOR JACK HAMMER

This is a continuation of co-pending application Ser. No. 07/534,961, filed on June 8, 1990, now abandoned and which designated the U.S.

BACKGROUND OF THE INVENTION

1. Field of the Invention

The present invention is an accessory that can be attached to the reciprocating member of a jack hammer or pneumatically-driven pavement breaker to adapt it for controllably driving stakes of various sizes and shapes into the ground.

2. The Prior Art

The accessory of the present invention is intended for use with jack hammers of the type widely used by road repair crews for breaking a paved surface. Such jack hammers are usually powered by compressed air supplied through a hose. Electrically-driven jack hammers are also known, as are hydraulically-driven instruments. However, the present invention is not a jack hammer, but instead is an accessory that replaces the reciprocating cutting blade to permit the jack hammer to be used for driving stakes, including fence posts, into the ground.

In U.S. Pat. No. 3,543,868, issued Dec. 1, 1970, Drake shows the use of a seal ring member that encircles the upper end of a stake to center the stake with respect to the reciprocating impact member of a jack hammer.

Likewise, in U.S. Pat. No. 1,853,128, issued Apr. 12, 1932 to Hysing, et al., there is shown a resilient sleeve that is used for gripping the upper end of a boring tool as it is being driven by a motor-driven striking tool, such as a rivet gun.

In U.S. Pat. No. 3,827,509, issued Aug. 6, 19874 to Larson, there is shown an accessory for use with paving breakers or similar power hammers that permits those tools to be used to drive railroad spikes. There appears to be no provision for grasping the spike.

In U.S. Pat. No. 1,827,957, issued Oct. 20, 1931, Shaw shows at attachment that clamps to a jack hammer and that includes a U-shaped channel that loosely grips the end of a board for the purpose of driving it. There is no provision for clamping the accessory to the board.

In U.S. Pat. No. 3,454,113, issued July 8, 1969, Holtz shows a vice-like device that clamps to a fence post and that serves as an anvil, which is then pounded by a power hammer. Likewise, Moore in U.S. Pat. No. 3,499,497 issued Mar. 10, 1970 shows a different type of anvil that is pounded by a power hammer to drive a sign pole into the ground. In both the inventions of Holtz and of Moore, the hammer is inclined at an angle with respect to the direction of the post being driven.

From the above patents it can be seen that various techniques have been employed for using a pneumatic hammer to drive posts and stakes, but none of them appears to grip the stake firmly while maintaining the stake in line with the reciprocating member of the pneumatic hammer to permit better control of the stake-driving process by the user. Further, it appears that the known accessories cannot accommodate stakes of various cross sectional sizes and shapes.

SUMMARY OF THE INVENTION

It is an objective of the present invention to provide a stake setter accessory for a jack hammer that can be used interchangeably with stakes having the more common cross sectional sizes and shapes.

It is a further objective of the present invention to provide a stake driver that securely grips the top portion of the stake so that the user can more closely control the direction in which the stake is being driven.

It is a further objective of the present invention to provide a stake setter that holds the stake in a position that is in line with the direction of motion of the reciprocating member of the jack hammer.

The present invention is an improvement on known stake setters in that it includes a clamping device that securely grips the top portion of the stake, so that each blow of the hammer is delivered squarely to the stake. Because the stake is securely held in line with the reciprocating member of the hammer, the accessory of the present invention provides improved control by the user of the direction the stake is being driven.

The present invention includes a stake-receiving portion that is sized and shaped to accommodate interchangeably the more common sizes and shapes of stakes.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

BRIEF DESCRIPTION OF THE DRAWINGS

FIG. 3 is a diagrammatic end view of the embodiment of FIG. 1 holding a round metal stake;

FIG. 4 is a diagrammatic end view of the embodiment of FIG. 1 holding a T-shaped metal stake;

FIG. 5 is a diagrammatic end view of the embodiment of FIG. 1 holding a smaller rectangular stake; and, FIG. 6 is a diagrammatic end view of the embodiment of FIG. 1 holding a larger rectangular stake.

DETAILED DESCRIPTION OF THE PREFERRED EMBODIMENTS

Figure 1:
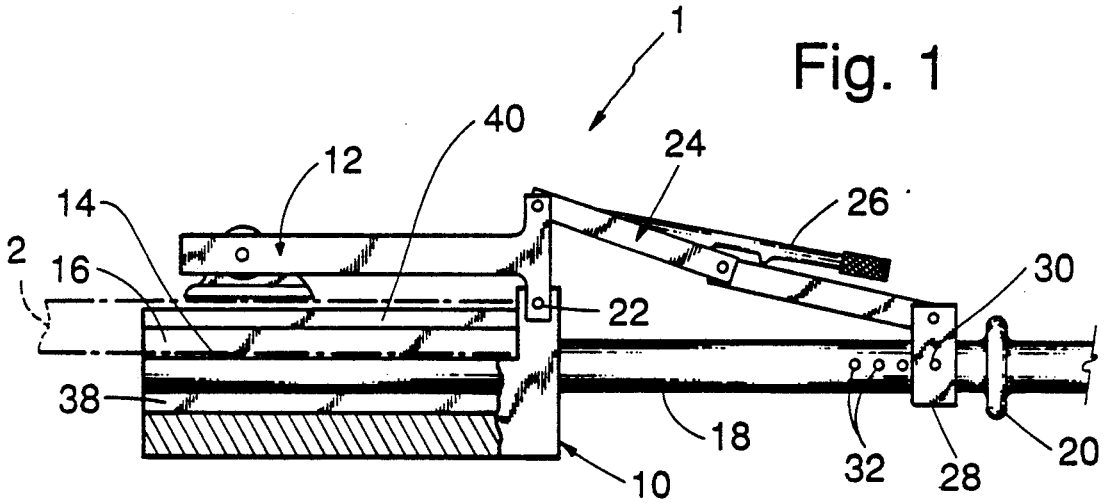
FIG. 1 is a side elevational view showing a first preferred embodiment of the accessory of the present invention.

FIG. 1 shows a first preferred embodiment of a accessory in which a stake 2, shown in phantom lines, lies within a stake 2 receiver 10 and is secured therein by a jaw 12. The stake receiver 10 includes a channel 14 which comprises a first guide way 16, and a second guide way 40 which extend in the direction the jaw 12 opens.

The stake receiver 10 also includes a shank 18 that includes a shoulder 20 by which the accessory 1 is secured to a jack hammer (not shown).

Figure 2:
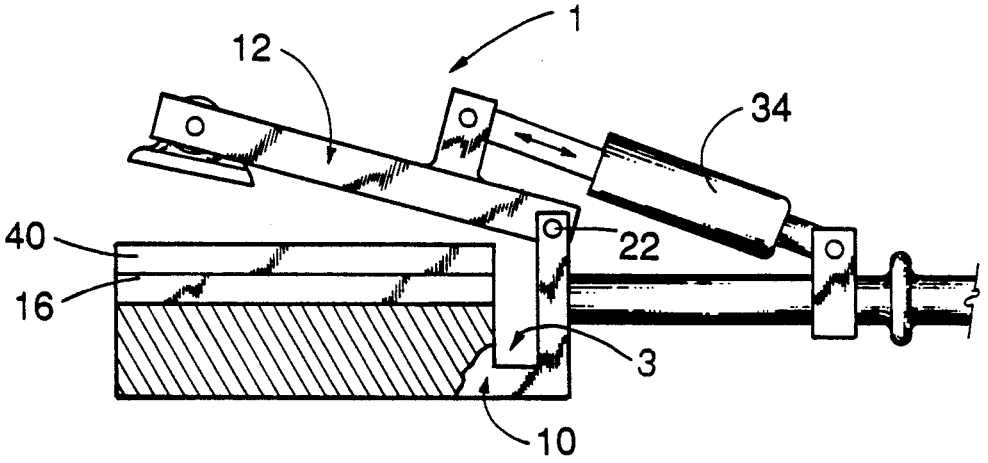
FIG. 2 is a side elevational view showing a second preferred embodiment of the accessory of the present invention.

The jaw 12 is pivotally attached to the stake receiver 10 by a first pin 22 which permits the jaw 12 to pivot from an open position, such as the position shown in FIG. 2, to a closed position, such as shown in FIG. 1.

In the embodiment of FIG. 1, an over-center clamping linkage 24 causes the jaw 12 to grip the stake 2 tightly, and secures the jaw 12 in the closed position until the operator releases the clamping linkage 24 by means of a handle 26. Stakes 2 of various sizes are accommodated by adjustment of a slidable collar 28 which is secured to the shank 18 by a second pin 30 that extends through one of several holes 32.

In the embodiment of FIG. 2, the clamping linkage 24 of FIG. 1 is replaced by a ram 34. In a first variation, the ram 34 is energized by compressed air, but in another variation, the ram is energized by hydraulic fluid under pressure. In yet another embodiment, the ram 34 is replaced by an electrical solenoid.

FIG. 2 also depicts a notch 3 for receiving stakes 2 having rounded ends (not shown). It is well known in the art that stakes may acquire rounded ends from being driven into the ground with a mallet.

FIGS. 3–6 are end views in the direction 3--3 indicated in FIG. 1. They show the accessory 1 as used with, respectively, a round stake 4 of FIG. 3, a T-shaped stake 6 of FIG. 4, a rectangular stake 8 of FIG. 5, and a larger rectangular stake 8' of FIG. 6. This ability of the accessory 1 to accommodate stakes of various sizes and shapes is a result of the structure of the stake receiver 10.

The stake receiver 10 includes a first guide way 36 of approximately semi-circular cross section that is useful in keeping the round stake 4 aligned with the direction of motion of the reciprocating member of the jack hammer, as shown in FIG. 3.

The first guide way 36 includes a relieved portion or second guide way that permits the stake receiver 10 to accommodate the T-shaped stake 6 shown in FIG. 4 and to keep it aligned with the direction of motion of the reciprocating member of the jack hammer.

The third guide way 16 slightly exceeds the width of a smaller rectangular stake 8. When that stake 8 is used, the third guide way 16 keeps the stake 8 aligned with the direction of motion of the reciprocating member of the jack hammer, as shown in FIG. 5.

Similarly, the second guide way 16 slightly exceeds the width of a larger rectangular stake 8'. When that stake 8' is used, the fourth guide way 40 keeps the stake 8' aligned with the direction of motion of the reciprocating member of the jack hammer, with the stake 8' bearing against the surfaces 42 of the fourth guide way 40, as shown in FIG. 6.

Thus, the accessory 1 of the present invention includes a clamping linkage 24 that secures the stake 2, 4, 6, 8, 8' to the accessory 1, and further includes the guide ways 16, 36, 38, 40 that serve to hold the stakes 2, 4, 6, 8, 8' in alignment with the intended direction and that permit the user to manipulate the jack hammer to control the direction in which the stake 2, 4, 6, 8, 8' is being driven.

Thus, there has been described an accessory for a jack hammer that grips the upper end of a stake for controllably driving it into the ground. The present invention should prove to be useful in the construction field where concrete stakes must be driven as well as for driving fence stakes.

The foregoing detailed description is illustrative of several embodiments of the invention, and it is to be understood that additional embodiments thereof will be obvious to those skilled in the art. The embodiments described herein together with those additional embodiments are considered to be within the scope of the invention.

What is claimed is:

1. An accessory for a jack hammer comprising:

a stake receiver having superimposed fixed guide ways front to back forming an axial channel, a cross-section of said channel having first and second sets of substantially orthogonal walls, said first and second sets being mutually spaced with a wall from each set being mutually parallel, a curved indentation disposed between said second set of walls, and a notched disposed within said indentation;

attachment means for attaching the accessory to said jack hammer;

a jaw attached to said stake receiver and movable from an open position to a closed position in which said jaw contacts an inserted stake; and clamping means for holding the stake between the jaw and the channel.

2. The accessory of claim 1 wherein said clamping means further comprises over-center locking means for locking said jaw in the closed position.

3. The accessory of claim 1 wherein said clamping means further comprises pneumatic ram means for moving said jaw.

4. The accessory of claim 1 wherein said clamping means further comprises hydraulic ram means for moving said jaw.

5. The accessory of claim 1 wherein said clamping means further comprises solenoid means for moving said jaw.

6. The accessory of claim 1 wherein said attachment means comprises a shank sized and dimensioned to be received by a reciprocating member of said jack hammer.

7. An improved jack hammer in which the improvement comprises:

a stake receiver having superimposed fixed guide ways for receiving stakes having one of essentially rectangular, round and T-shaped cross-sections, said guide ways front to back forming an axial channel, a cross-section of said channel having first and second sets of substantially orthogonal walls, said first and second sets being mutually spaced with a wall from each set being mutually parallel, a curved indentation disposed between said second set of walls, and a notch disposed within said indentation;

means for securing the stake receiver to the jack hammer; and means for securing the stakes within the stake receiver.

* * * * *